US005382028A

United States Patent [19]

Sciandra et al.

[11] Patent Number: 5,382,028

[45] Date of Patent: Jan. 17, 1995

[54] APPARATUS AND METHOD OF PLAY FOR A DISC TOSSING GAME

[76] Inventors: Charles C. Sciandra, 1426 Westwood Dr.; Paul L. Swisher, 27 Hagen Ave., both of Tonawanda, N.Y. 14120

[21] Appl. No.: 144,435

[22] Filed: Nov. 2, 1993

[51] Int. Cl.[6] ..... A63B 67/06

[52] U.S. Cl. ..... 273/401

[58] Field of Search ..... 273/398, 399, 400, 401, 273/402, 424, 425, 348, 353

[56] References Cited

U.S. PATENT DOCUMENTS

| | | | |
|---|---|---|---|
| D. 333,896 | 3/1993 | Starkweather | D34/5 |
| 1,114,523 | 10/1914 | Revell | 273/398 X |
| 2,509,634 | 5/1950 | Freeman | 273/353 X |
| 3,881,728 | 5/1975 | Martyn | 273/353 |
| 4,114,885 | 9/1978 | Morrow | 273/424 |
| 4,224,682 | 5/1980 | Brown | 273/401 |
| 4,335,881 | 6/1982 | Warehime | 273/348 |
| 4,968,041 | 11/1990 | Calvo | 273/401 |
| 5,048,845 | 9/1991 | Dunipace | 273/400 |
| 5,050,955 | 10/1991 | Bible | 273/400 |
| 5,056,797 | 10/1991 | Hockert et al. | 273/402 |
| 5,123,656 | 6/1992 | Green | 273/400 |

*Primary Examiner*—William H. Grieb

*Attorney, Agent, or Firm*—Richard C. Litman

[57] ABSTRACT

An apparatus and a method of play for a disc tossing game is disclosed. The apparatus includes two tapered, generally cylindrical containers with a slot in their sides and a disc with dull edges. When the disc tossing game is played in a yard or a park, the containers may have an open top and a closed bottom with the top having a larger diameter than the bottom. When the disc tossing game is played on a beach or indoors, e.g., in an indoor gymnasium, the containers may have an open top and an open bottom where the top has a smaller diameter than the bottom. The players always have an option as to which container is used in any type of playing situation. When the disc tossing game is played, the two containers are placed at a distance from each other and the disc is tossed at each of the containers in turn with each toss being scored and a winner being declared when one of two two-player teams reaches a score of exactly twenty-one.

14 Claims, 4 Drawing Sheets

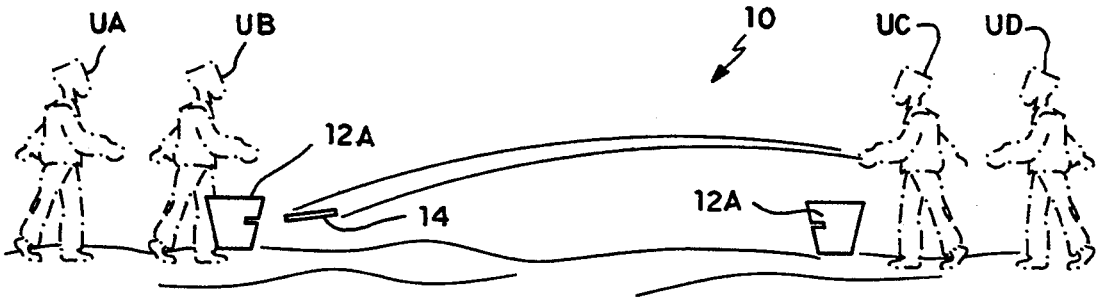
Fig. 1
Fig. 6
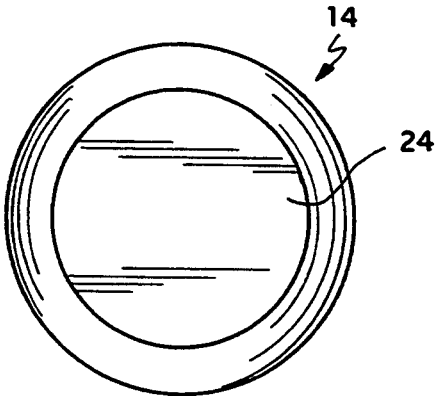
Fig. 7
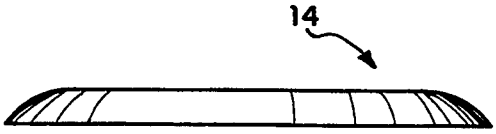

APPARATUS AND METHOD OF PLAY FOR A DISC TOSSING GAME

BACKGROUND OF THE INVENTION

1. FIELD OF THE INVENTION

The present invention relates to an apparatus and a method of play for a game which is played by tossing a disc at each of two containers in turn by each of four players which are divided into two two-player teams.

2. DESCRIPTION OF THE PRIOR ART

U.S. Design Pat. No. 333,896 issued Mar. 9, 1993 to Charles W. Starkweather, discloses a trash bag trolley which has a circular opening at the top, is closed at the bottom and tapers from bottom to top. However, there is no disclosure or showing for using this trash bag trolley as part of a disc toss game.

U.S. Pat. No. 4,114,885 discloses a throwing disc which has a solid circular shape with dull edges. There is no disclosure or showing for forming this throwing disc as a doughnut shape or for using this disc in conjunction with a container for use in a target-type of toss game.

In U.S. Pat. No. 4,204,682 issued May 27, 1980 to Floyd E. Brown, a method and apparatus for an outdoor tossing game is disclosed where a toroidal disc is tossed at a cup which has been placed in the ground below ground level. The cup has straight sides.

U.S. Pat. No. 5,048,845 issued Sept. 17, 1991 to David B. Dunipace, discloses an entrapment assembly for use in capturing a solid, circular disc during a disc tossing game. The entrapment assembly is in the form of a cage which is operatively connected to a pedestal.

In the penultimate patent, U.S. Pat. No. 5,056,797 issued Oct. 15, 1991 to Tad L. Hockert and Steven L. Hockert is disclosed a disk toss game where a solid circular or a toroidal disc is tossed at a target board which is formed with a layer of soft foam material to prevent the tossed disc from bouncing off of the target board.

Lastly, U.S. Pat. No. 5,123,656 issued Jun. 23, 1992 to James E. Green discloses an apparatus and method for playing a game of toss. This game of toss utilizes objects such as bean bags or balls for tossing toward a target cylindrical receptacle. The target receptacle consists of a cylinder with outer and inner walls.

None of the above inventions and patents, taken either singly or in combination, is seen to describe the instant invention as claimed.

SUMMARY OF THE INVENTION

This game is played primarily outdoors or indoors where there is plenty of room. The game uses two tapered, generally cylindrical containers, each of which has a horizontal slot in the center of one side, and a toroidal or doughnut-shaped disc with dull edges or a solid circular disc. The game is played with two two-player teams with the two containers placed at opposite ends of a playing field with one player from each team standing near each of the two containers. The order of team play can be determined by a coin flip or any other starting procedure determined by the team players. The winner of any of the above starting procedures has the option of whether they want the last toss (which is called "The Hammer".) Having "The Hammer" or last toss is significant because it allows the team with the last toss to tie or win the game. This option is exactly the same as having the last at bats in baseball. The first player from the starting team tosses the disc down to the opposing container with the other player from that team tossing the disc back to the original container, then the other team follows the same procedure, thus completing one (1) round. After each player tosses the disc, the toss is scored depending on whether or not the disc enters the appropriate container or whether or not the disc hits the container assisted or unassisted. If the disc enters the slot with no assistance then the team which has caused the disc to enter the slot unassisted instantly wins the game with a score of twenty-one points. If one of the teams achieves a score of exactly twenty-one and both of the teams have had an equal number of turns, then the team which has a score of exactly twenty-one wins. However, if one of the teams has achieved a score of exactly twenty-one and the other team has not had their last turn yet, then the other team takes their last turn to determine their final score. If both of the teams end up with a score of exactly twenty-one after an equal number of turns, an overtime round is played. If one of the teams has achieved a higher score than the other team in the overtime round the team with the higher score wins. If the game remains tied additional overtime rounds are played until a winner is determined. The game may be played with the containers having their largest end upwards if the game is being played either in a yard or a park, while the containers may be placed with their smallest end upwards if the game is being played either at the beach or indoors, e.g., in an indoors gym. This is totally the player's choice of which receptacle they like to use.

Accordingly, it is a principal object of the invention to have a disc tossing game with two tapered, generally cylindrical containers with an open top, a closed bottom and a slot which may be used to play the game in a yard or in a park.

It is another object of the invention to have a disc tossing game with two tapered, generally cylindrical containers with an open bottom, an open top and a slot which may be used to play the game at the beach or indoors.

It is a further object of the invention to provide the disc tossing game with a toroidal or doughnut-shaped disc or solid circular disc to be tossed at the containers which have slots to score points according to how the disc lands at or near the containers.

Still another object of the invention is to provide a disc tossing game which is played by four players that are divided into two two-player teams.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

FIG. 1 is an environmental view of the disc toss game being used in a yard.

FIG. 6 is a front elevational view of the disc used in the disc tossing game.

FIG. 7 is a top plan view of the disc of FIG. 6.

Similar reference characters denote corresponding features consistently throughout the attached drawings.

DETAILED DESCRIPTION OF THE PREFERRED EMBODIMENTS

The present invention, generally shown in FIG. 1, is a disc tossing game 10 which is played with two tapered, generally cylindrical containers 12 and a toroidal or doughnut-shaped disc or solid circular disc 14. The disc tossing game 10 is played by four players UA, UB, UC, UD. This game can be played outdoors or indoors wherever there is a lot of room, e.g., in an indoor gymnasium. Containers 12 may be made of any suitable material such as plastic, rubber, steel or aluminum while disc 14 is preferably made from a plastic material.

Figure 2:
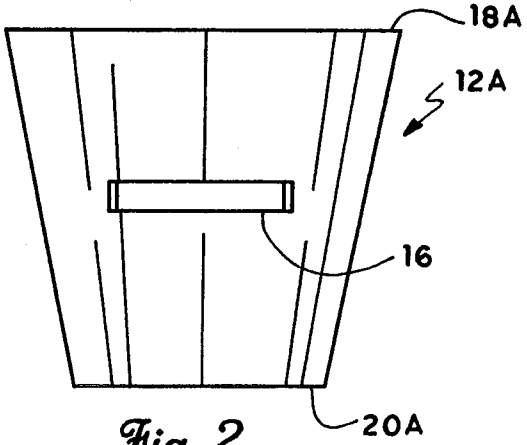
FIG. 2 is a front elevational view of the container as it would be set up for play in a yard or a park.
Figure 3:
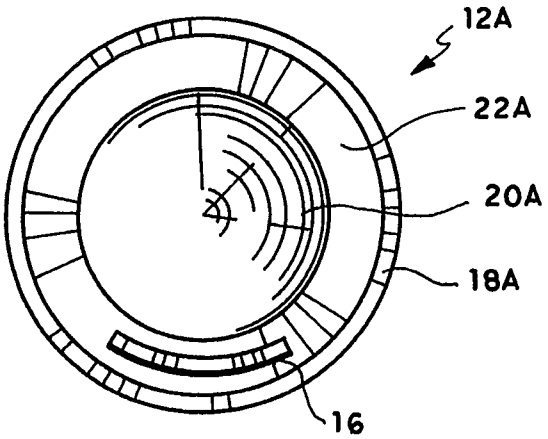
FIG. 3 is a top plan view of the container of FIG. 2.

Referring now to FIGS. 2 and 3, when disc tossing game 10 is played in a yard or at a park, container 12A is formed with an open top 18A and a closed bottom 20A. Open top 18A is larger in diameter than closed bottom 20A. Preferably, open top 18A has a diameter of approximately seventeen inches to eighteen inches (17"–18") while the closed bottom 20A has a preferred diameter of approximately sixteen inches to seventeen inches (16"–17"). Container 12A has a tapered side 22A which has a preferred height of approximately twenty-three inches (23") with a slot 16 formed in the central horizontal plane of side 22A.

Figure 4:
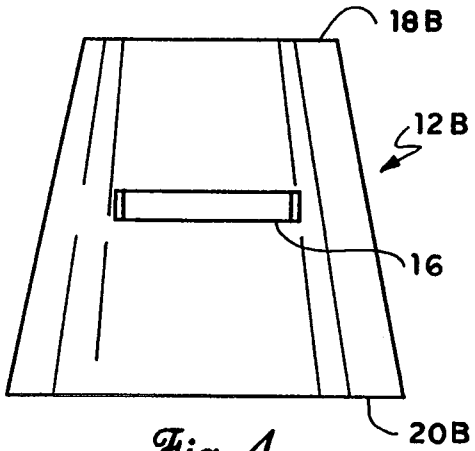
FIG. 4 is a front elevational view of another type of container as it would be set up for play on a beach or indoors.
Figure 5:
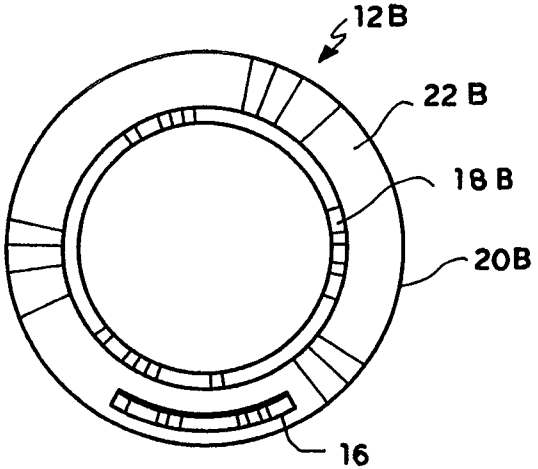
FIG. 5 is a top plan view of the container of FIG. 4.

FIGS. 4 and 5 depict a container 12B such as would be used to play the disc tossing game 10 on a beach or indoors, e.g., in an indoors gymnasium. In this embodiment, container 12B is formed with an open top 18B and an open bottom 20B. Open top 18B has a smaller diameter than open bottom 20B. Preferably, open top 18B has a diameter of approximately sixteen inches to seventeen inches (16"–17") and open bottom has a diameter of approximately seventeen inches to eighteen inches (17"–18"). Container 12B has a tapered side with a preferred height of approximately twenty-three inches (23") with a slot 16 formed in a central horizontal plane of side 22B.

In either of the preferred embodiments, slot 16 has a preferred width of approximately twelve inches (12") and a preferred height of approximately two inches (2"). Referring to FIGS. 6 and 7, disc 14 has a preferred diameter of approximately ten inches (10") and a preferred height of approximately one inch (1") such that disc 14 has enough clearance to fit through slot 16 while still presenting enough of a challenge to a player UA, UB, UC, or UD when trying to toss disc 14 through slot 16 from a given distance. Containers 12 are set up a given distance apart from each other for the disc tossing game where the distance is determined by the desired level of difficulty. Preferred distances between containers 12 include: forty feet (40') for a beginners' level, fifty feet (50') for an intermediate level, and sixty-five feet (65') for an advanced level.

Figure 8A:
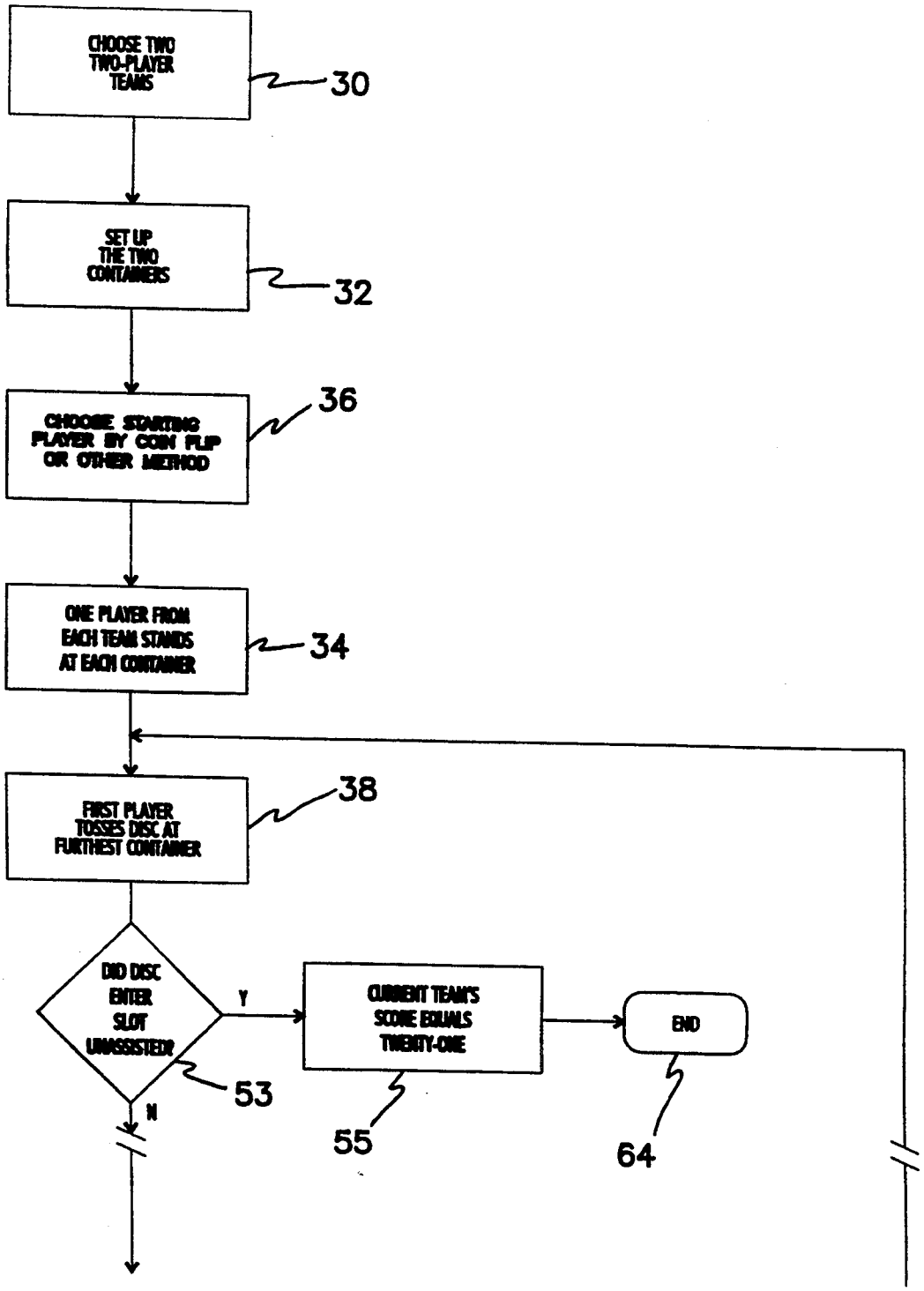
FIGS. 8A and 8B, taken together, are a block diagram of the method of playing the disc tossing game.
Figure 8B:
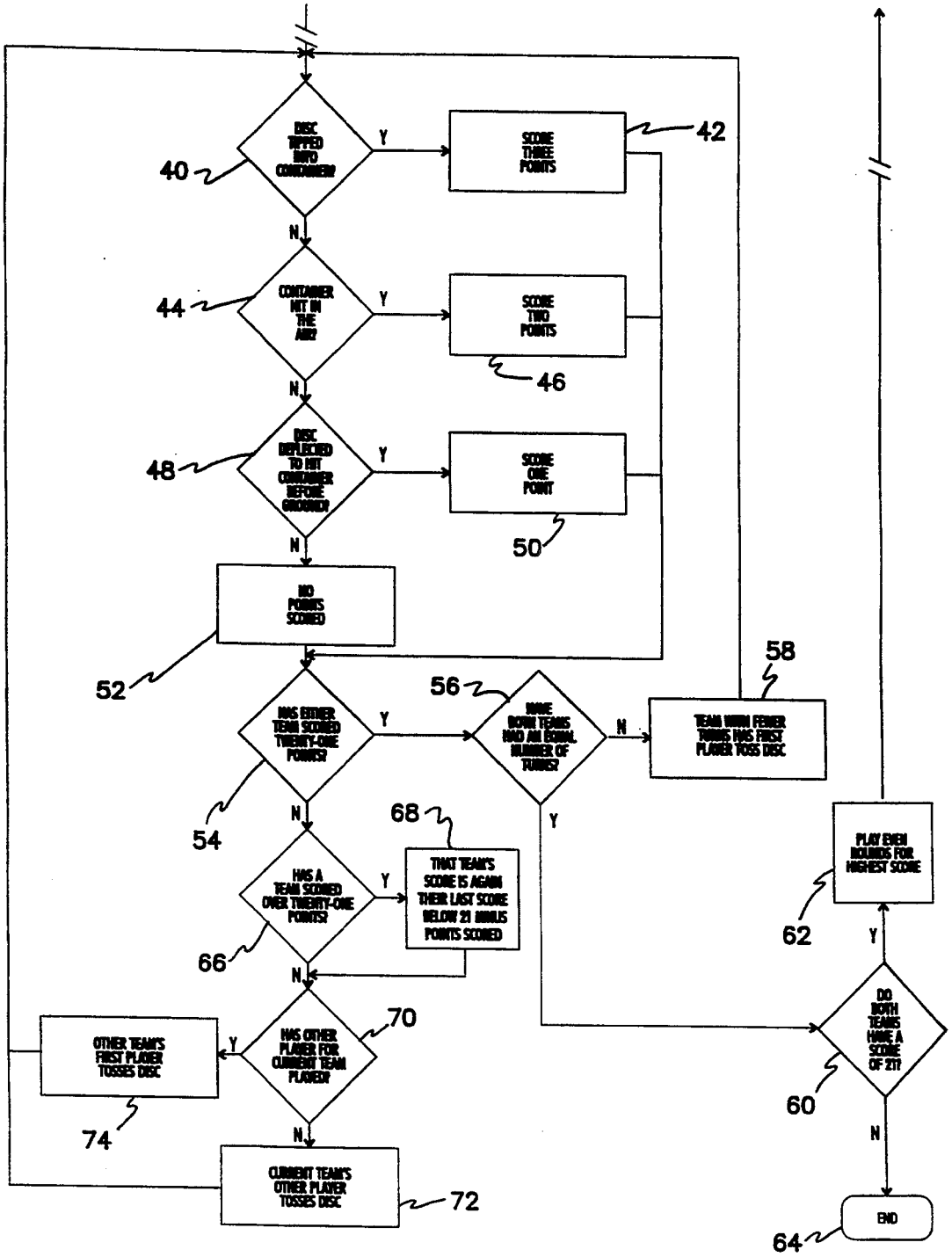

The method of playing the disc tossing game is illustrated in FIGS. 8A and 8B, with an explanation following hereinafter. Two teams with two players each are chosen 30 and two tapered, generally cylindrical containers are set up at a given distance according to the desired level of difficulty 32. One player from each team then stands behind each of the containers 34 and a starting player is chosen by a coin flip 36 or other method. The team which calls the correct coin flip gets to choose if they want the last throw, "The Hammer". Then, a starting player from the starting team tosses the disc at the container which is furthest from him 38 and the toss is scored 40, 42, 44, 46, 48, 50, 52. If the disc enters the slot of the container unassisted (53, FIG. 8A), the starting player scores twenty-one points for his team (55, FIG. 8A) and the game ends instantly with the starting team winning the game, 64. If the disc is tipped into the top or side of container by the team member 40, then the starting team scores three (3) points 42 and the game continues. If the disc hits the container while it is in the air unassisted 44, then the starting player scores two (2) points 46 and the game continues. If the container is hit by the disc after the disc has been deflected by the current player's teammate and before the disc hits the ground 48, then the starting player scores one (1) point 50 and the game continues. Otherwise, the starting player scores no points 52 and the game continues.

After the starting player's toss has been scored, a determination is made as to whether or not either of the team's has scored exactly twenty-one (21) points 54. If one of the teams has scored exactly twenty-one (21) points, then it is determined whether or not both teams have had an equal number of turns 56. If one of the teams has had a fewer number of turns than the other team, then the team with the fewest number of turns has its first player toss the disc at the container which is furthest from its first player 58. This toss is then scored in a similar manner to the scoring of the starting player's toss 40, 42, 44, 46, 48, 50, 52. However, if both teams have had an equal number of turns, then it is determined whether or not both of the teams have a score of exactly twenty-one (21) points 60. If both teams have a score of exactly twenty-one (21) points, then the game is continued in sudden death mode where even rounds are played until one of the teams has scored a higher score than the other team 62 with each toss being scored in the same manner as the starting player's toss 40, 42, 44, 46, 48, 50, 52. If both teams have had an equal number of turns and only one team has a score of exactly twenty-one (21) points, then the game ends 64 and the team with the score of exactly twenty-one (21) points is declared the winner.

If neither team has scored exactly twenty-one (21) points after a toss of the disc by a player, then it is determined whether or not the team which has just had a player toss the disc has scored over twenty-one (21) points 66. If that team has exceeded a score of twenty-one (21) points, then that team's score is lowered to the score which that team had before that team exceeded the score of twenty-one (21) points minus the points of the toss 68. If both teams have a score of less than twenty-one (21) points, then it is determined whether or not both players from the team on which the player which has just tossed the disc is on have had their turns at tossing the disc 70. If both players from that team have had their turns at tossing the disc, then the first player from the other team tosses the disc 74 and that toss is scored 40, 42, 44, 46, 48, 50, 52. If one of the players from the team which has just had a player toss the disc has not had their turn, then that player tosses the disc 72 and that toss is scored 40, 42, 44, 46, 48, 50, 52.

It is to be understood that the present invention is not limited to the sole embodiment described above, but encompasses any and all embodiments within the scope of the following claims.

We claim:

1. A disc tossing game played on a supporting surface comprising:

a first tapered, substantially cylindrical container having at least a side wall defining a top including a top opening, said top having a circumference of a predetermined diameter, said first container side wall having at least a first container slot;

a second tapered substantially cylindrical container having at least a side wall defining a top including a top opening, said top having a circumference of a predetermined diameter, said second container side wall having at least a second container slot; and a toroidal disc having at least a predetermined thickness and a circumference of a predetermined diameter;

wherein said first container and said second container have substantially the same height; said first container and said second container being spaced a predetermined distance apart and located above and supported on the supporting surface, so said toroidal disc may strike a portion of the side wall of one of said containers, enter the top opening of one of said containers or enter the slot of one of said containers when said toroidal disc is propelled toward one of said containers.

2. The disc tossing game according to claim 1, wherein each of said two containers is made of an opaque material.

3. The disc tossing game according to claim 1, wherein said disc is made of plastic.

4. The disc tossing game according to claim 1, wherein said first container further comprises a bottom having a predetermined diameter, said diameter of said top is larger than said diameter of said first bottom;

said second container further comprises a bottom having a predetermined diameter, said diameter of said top is larger than said diameter of said second bottom;

said first container slot is located in a central horizontal plane of said first container; and said second container slot is located in a central horizontal plane of said second container.

5. The disc tossing game according to claim 4, wherein said first container has at least a closed bottom; and said second container has at least a closed bottom.

6. The disc tossing game according to claim 1, wherein said first container further comprises a bottom having a predetermined diameter, said diameter of said top is smaller than said diameter of said bottom;

said second container further comprises a bottom having a predetermined diameter, said diameter of said top is smaller than said diameter of said bottom;

said first container slot is located in a central horizontal plane of said first container; and said second container slot is located in a central horizontal plane of said second container.

7. The disc tossing game according to claim 6, wherein said first container side wall further defining a bottom including a bottom opening; and said second container side wall further defining a bottom including a bottom opening.

8. The disc tossing game according to claim 1, wherein said toroidal disc having at least a lateral dimension and a thickness, said first container slot having at least a length and height, said lateral dimension of said toroidal disc is at least 83% of the length of said first container slot.

9. The disc tossing game according to claim 1, wherein said toroidal disc having at least a lateral dimension and a thickness, said first container slot having at least a length and height, said thickness of said toroidal disc is at least 50% of the height of said first container slot.

10. A method of play for a disc tossing game, including the steps of:

choosing two teams wherein each team consists of two players;

placing two tapered, slotted, generally cylindrical containers at a given distance from each other, so the slots are in facing arrangement;

standing all players behind a first of said two containers;

choosing a starting team and a nonstarting team by a coin flip;

standing a starting player of said starting team behind said first of said two containers;

standing a nonstarting player of said starting team behind a second of said two containers;

standing a starting player of said nonstarting team behind said first container;

standing a nonstarting player of said nonstarting team behind said second container;

tossing of a toroidal disc by said starting player of said starting team at said second container;

tossing of said toroidal disc by each player in turn at whichever container is furthest from a current player;

determining a score for each said tossing of said toroidal disc by awarding points when said disc strikes said container furthest from said current player, enters a slot in said container furthest from said current player or enters a top in said container furthest from said current player; and determining a winner of said disc tossing game.

11. The method of play for the disc tossing game according to claim 10, said step of choosing a starting team and said nonstarting team by a coin flip further including the steps of:

choosing between heads or tails by a starting player on one of said two teams; whereby if said coin flip of said coin matches choice by said starting player on said one of said two teams, then said starting team of said one of said two teams gets to choose whether or not to take the last possible toss of the disc during each round.

12. The method of play for the disc tossing game according to claim 10, said step of determining a score further including the steps of:

determining whether said disc enters a slot or a top in said container which is furthest from said current player;

scoring twenty-one points by a team which said current player is on if said disc enters said slot or said top unassisted;

winning of said game by said team which said current player is on if said disc enters said slot or said top unassisted;

determining whether said disc is tipped into said second container by a teammate of said starting player of said starting team;

scoring three points by said starting player of said starting team if said disc is tipped into said second container by said teammate of said starting player of said starting team;

determining whether said second container is hit by said disc unassisted while said disc is still in the air;

scoring two points by said starting player of said starting team if said second container is hit by said disc while said disc is still in the air unassisted;

determining whether said disc is deflected by said teammate to hit said second container before said disc hits ground;

scoring one point by said starting player of said starting team if said disc is deflected by said teammate to hit said second container before said disc hits said ground; and scoring no points by said starting player of said starting team if said disc is not tipped by said teammate into said second container, said second container is not hit by said disc while said disc is still in the air unassisted and if said disc is not deflected by said teammate to hit said second container before said disc hits said ground.

13. The method of play for the disc tossing game according to claim 10, said step of determining said winner of said disc tossing game further including the steps of:

determining if either of said two teams has scored exactly twenty-one points;

determining if both teams have had an equal number of turns if one of said two teams has scored exactly twenty-one points;

tossing of said disc by said starting player of a team which has had a lesser number of turns if said two teams have not had an equal number of turns and if one of said two teams has scored exactly twenty-one points;

determining if both teams have scored exactly twenty-one points if at least one of said two teams have scored exactly twenty-one points and if both teams have had an equal number of turns;

determining a winner by playing even overtime rounds until one team has a higher score than another team if both teams have scored exactly twenty-one points;

scoring said tossing of said disc by said starting player of a team which has had a lesser number of turns if said two teams have not had an equal number of turns and if one of said two teams has scored exactly twenty-one points;

determining if one of said two teams has scored more than twenty-one points if neither of said two teams has scored exactly twenty-one points;

lowering a score for a team which has scored more than twenty-one points to a score which said team which has scored more than twenty-one points had before a player on said team which has scored more than twenty-one points last tossed said disc minus a number of points scored during said toss;

determining whether a nonstarting player from a last team to have tossed said disc has tossed said disc;

tossing of said disc by said nonstarting player from said last team to have tossed said disc if said nonstarting player from said last team to have tossed said disc has not tossed said disc;

tossing of said disc by a starting player from a team which was not said last team to have tossed said disc if said nonstarting player from said last team to have tossed said disc has tossed said disc;

scoring said tossing of said disc whenever said disc is tossed by any player; and declaring that a team with a score of exactly twenty-one is a winner of said disc tossing game if both teams have had an equal number of turns and if another team does not have a score of exactly twenty-one points.

14. A method of playing a disc tossing game on a supporting surface for teams of at least two players comprising the steps of:

placing a first slotted, hollow container on top of a supporting surface a predetermined distance from a second slotted, hollow container so the slots are in a facing relationship and the containers are located substantially entirely above the supporting surface;

standing a first player of a first team behind the first container;

standing a second player of the first team proximal to the second container.;

tossing a toroidal disc by the first player of the first team toward the second container;

awarding 21 points when the disc enters the second container through an open top or the slot of the second container without contacting the supporting surface or the second player; awarding 3 points when the disc enters the second container through an open top of the second container after contacting the second player without contacting the supporting surface;

awarding 2 points when the disc contacts the second container without contacting the second player or the supporting surface;

determining a point total for the first player of the first team;

tossing the toroidal disc by the second player of the first team toward the first container;

awarding 21 points when the disc enters the first container through an open top or the slot of the first container without contacting the supporting surface or the first player;

awarding 3 points when the disc enters the first container through an open top of the first container after contacting the first player without contacting the supporting surface;

awarding 2 points when the disc contacts the first container without contacting the first player or the supporting surface;

determining a point total for the first team;

standing a first player of a second team behind the first container;

standing a second player of the second team proximal to the second container;

tossing a toroidal disc by the first player of the second team toward the second container;

awarding 21 points when the disc enters the second container through an open top or the slot of the second container without contacting the supporting surface or the second player;

awarding 3 points when the disc enters the second container through an open top of the second container after contacting the second player without contacting the supporting surface;

awarding 2 points when the disc contacts the second container without contacting the second player or the supporting surface;

determining a point total for the first player of the second team;

tossing the toroidal disc by the second player of the second team toward the first container;

awarding 21 points when the disc enters the first container through an open top or the slot of the first container without contacting the supporting surface or the first player;

awarding 3 points when the disc enters the first container through an open top of the first container after contacting the first player without contacting the supporting surface;

awarding 2 points when the disc contacts the first container without contacting the first player or the supporting surface;

determining a point total for the second team.

* * * * *